United States Patent [19]

Stewart et al.

[11] 4,270,245

[45] Jun. 2, 1981

[54] LAG OR STAVE ASSEMBLY FOR KIRSCHNER BEATERS

[75] Inventors: David B. Stewart, Newtyle; William R. Stewart, Craigmount; John M. C. Dickinson, Largoward, by Elie, all of Scotland

[73] Assignee: Wm. R. Stewart & Sons (Hacklemakers) Ltd., Dundee, Scotland

[21] Appl. No.: 87,386

[22] Filed: Oct. 22, 1979

[30] Foreign Application Priority Data

Oct. 24, 1978 [GB] United Kingdom ..... 41779/78

[51] Int. Cl.[3] ..... D01G 9/04

[52] U.S. Cl. ..... 19/85; 19/94

[58] Field of Search ..... 18/85–95

[56] References Cited

U.S. PATENT DOCUMENTS

| | | | |
|---|---|---|---|
| 531,193 | 12/1894 | Kirschner | 19/86 |
| 1,485,240 | 2/1924 | Wilkinson | 19/86 |
| 1,891,132 | 12/1932 | Arnold | 19/94 |
| 2,423,928 | 7/1947 | Curley | 19/94 |
| 2,435,938 | 2/1948 | Curley | 19/86 |
| 2,952,047 | 9/1960 | Lytton et al. | 19/85 |
| 3,765,057 | 10/1973 | McLaughlin | 19/89 |

FOREIGN PATENT DOCUMENTS

| | | | |
|---|---|---|---|
| 12351 | of 1894 | United Kingdom | 19/86 |

*Primary Examiner*—Louis Rimrodt
*Attorney, Agent, or Firm*—Charles E. Brown

[57] ABSTRACT

A lag or stave assembly for a Kirschner beater which replaces the traditional one-piece wooden lags and is preferably formed from extruded aluminium. The lag assembly is formed in two parts with a first support part which is preferably channel-shaped and can be secured to the free end of an arm or spider of the beater, and a second pinned working part removably secured along its leading and trailing edges to the upper ends of the arms of the support part, one edge, preferably the leading edge, of the working part being secured to the support part removably and hingedly, e.g. by a hook-shaped tongue engaging in a mating groove, and the other edge being fixedly secured to the other arm of the support part, e.g. by means of screws and/or any type of snap-fit or interlock. The arrangement preferably ensures that one of the parts is loaded in tension or compression when the two parts are secured together to prevent rattling.

13 Claims, 6 Drawing Figures

LAG OR STAVE ASSEMBLY FOR KIRSCHNER BEATERS

This invention relates to lag or stave assemblies for Kirschner beaters.

A Kirschner beater is a multi-legged (normally 3) spider or device for a cotton opening machine. With this machine, bolls of cotton are combed by the rotating beater so as to open the fibres ready for subsequent processing operations. The beater normally has a spindle rotatable about its axis and projecting from the spindle are the three legs to the outer ends of which pinned staves or lags are secured by screws. When pins in the lags become worn or damaged, the lags have to be removed, repaired and replaced. Because of the large number of screws required this is a time-consuming and expensive job. Traditionally the lags or staves have been made of beechwood but recently constructions in aluminium have become known.

We have now designed a two-piece lag assembly to replace these traditional one-piece lags or staves.

According to the present invention, we provide a lag assembly for connection, e.g. by screws, to a leg of the spider of a Kirschner beater comprising a support part and a working part, the working part having a pinned surface which is convex when viewed transverse to its length, the working part being removably, hingedly secured along one longitudinal edge to the support part and its other edge being fixedly securable to the adjacent edge of the support part.

Preferably, the support part is of channel-shaped cross-section, the base of the channel being adapted for semi-permanent connection to an arm of the spider of a Kirschner beater.

Preferably, one arm of the channel has a curved groove formed therein which is engaged by a known hook formed on said one edge of the working part.

The other arm of the support part may have an enlarged end portion which may be threaded to receive one or more fixing screws projecting from the other edge of the working part.

In this construction the screws may extend substantially at right angles to the base of the channel.

The other edge of the working part may have a depending flange or projecting rib for connection with the support part, thus permitting pinning of substantially all the surface of the working part.

Preferably, the other edges of the two parts form a snap-fit with each other. They may be held together as well by screws.

Preferably, the two parts are assembled under load, i.e. tension or compression, to prevent any relative movement and thus rattling between the two parts during use.

Also according to the present invention, we provide a Kirschner beater for a cotton opening machine, the beater being rotatable about an axis and having a plurality of radially extending arms each having a lag assembly on its outer end, the lag assemblies being removably secured to the arms and including a support part and a working part, the working part having a longitudinally extending pinned surface which is convex, transverse to its length, and wherein one longitudinal edge of the working part is removably and hingedly connected to a corresponding edge of the support part, the opposite edges of the two parts being fixedly secured together after they have been brought together by pivoting of the working part about its one end.

Preferably, the hinged connection between the two lag parts is at the leading edge of the lag.

Preferably, the lag is formed of metal, e.g. aluminium or one of its alloys, in which case the two parts can be formed by extrusion and subsequently cut to length.

The invention is now described by way of example with reference to the accompanying drawings, in which.

Figure 1:
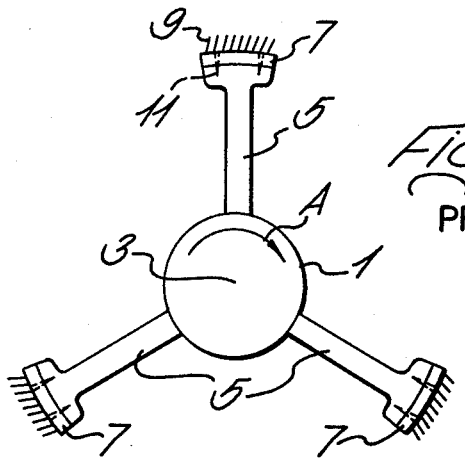
Fig. 1. PRIOR ART
FIG. 1 is an end elevation of a Kirschner beater.

Referring to FIG. 1 of the drawings, the Kirschner beater shown therein has a boss 1 rotatable in the direction of the arrow A about its longitudinal axis 3. Three radially extending arms 5 project from the boss 1 and in the known constructions of beater, a wooden lag or stave 7, which is pinned as shown at 9, is secured to the end face of each arm 5 by means of a plurality of screws 11. The tips of the pins 9 must be accurately located to provide the correct shape of working surface and since this is normally arcuate, the staves 7 themselves have to be very accurately manufactured, normally from beechwood and great care must also be exercised in fitting them to the end faces of the arms 5. The end faces themselves must be accurately shaped and it is a time-consuming job to assemble the staves on the arms 5 because of the large number of screws 11 required.

Figure 2:
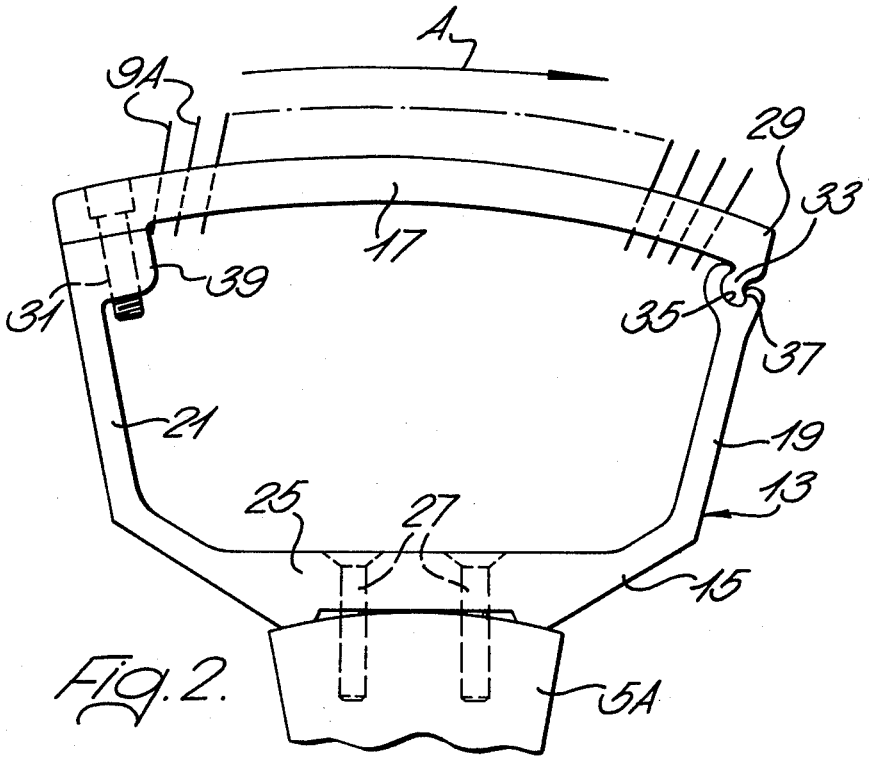
FIG. 2 is a section through one embodiment of lag assembly for use with a Kirschner beater such as shown in FIG. 1, but to a larger scale.

We are now proposing to replace the traditional solid wood staves 7 by a lightweight metal or hard plastics lag assembly 13 as shown in FIG. 2. The lag assembly 13 includes a support part 15 and a working part 17. Preferably, each of the parts 15 and 17 is extruded from an aluminium alloy and cut to the required length, the support part 15 being generally in the form of a U-shaped channel with one arm 19 being slightly shorter than the other arm 21. The working part 17 is of generally arcuate construction when viewed in cross-section and pins 9A are secured therein in known manner with the tail ends of the pins projecting from the rear surface of the part 17.

By making the support part 15 of extruded aluminium alloy, it is considerably stronger than the traditional beechwood stave and does not need to be supported over the whole of its surface area and this in turn means that the dimensions of each beater arm 5A can be scaled down. Hence, the end face 23 of each beater arm need not extend the whole width of the lag 13 but it can be specially machined for engagement with a central underneath face of the base 25 of the part 15. This base 25 can then be semi-permanently secured to the arm 5A by means of screws 27.

So that damaged or worn working parts 17 can quickly be replaced they are removably and hingedly secured at their leading edge 29 to the arm 19 and at their trailing edge they are secured to the arm 21 either by means of one or more screws 31 and/or by means of a snap-fit or interlock arrangement.

In the construction illustrated in FIG. 2, the lower face of the part 17 adjacent the leading edge 29 is formed with a depending hook-shaped tongue 33 which engages in a matching groove 35 formed in the top of the arm 19. The shape of these two parts 33 and 35 is such that with the part 17 rotated about its point of connection to the arm 19 through about 90° relative to the illustrated position, the tongue 33 can be pushed into the groove 35 without difficulty. By then rotating the part 17 anticlockwise to the illustrated position, the tip of the tongue 33 will move beneath an overhang 37 of the groove 35 and due to the narrowing of the groove 35 at its mouth, it will be retained therein. To maintain the two parts in their illustrated position, the or each screw 31 is/are screw-threaded into threaded bores formed in the enlarged top edge 39 of the arm 21.

While the above-described construction is very simple to manufacture, it does suffer from one minor disadvantage in that, in the vicinity of the screws 31, a portion of the top convex surface of the part 17 cannot be pinned firstly because of the presence of the apertures for the screws 31 and secondly because the tails of the pins 9A would foul the enlarged portion 39.

In order to overcome the above disadvantage, several different constructions are envisaged for fixedly securing the trailing edge of the part 17 to the arm 21 (see FIGS. 3–6). For example, a depending flange 40 (FIG. 3) with a step 42 could be provided at the trailing edge of the part 17 for location inside the arm 21, in which case the enlarged portion 39 is modified, and provided with a nose 44 for engagement with step 42. This construction could be sprung into place, or held in place by one or more studs 46.

Figure 4:
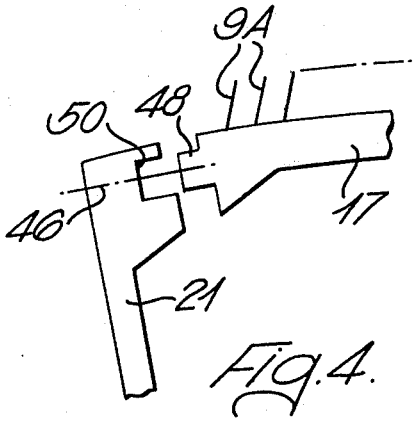
Figure 5:
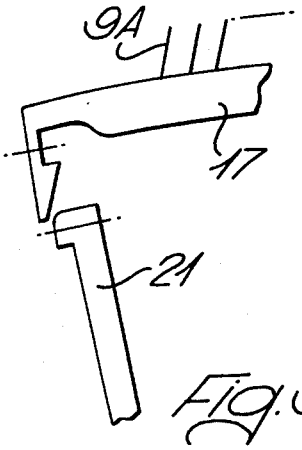
Figure 6:
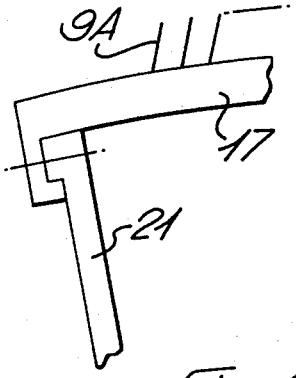

Alternatively, as shown in FIG. 4, a projecting rib 48 could be provided on the part 17 (or the part 21) which engages in a mating slot 50 on the other part. Alternative rib and slot constructions are shown in FIGS. 5 and 6 which can be fixedly secured together either with a snap-fit or interlock (FIG. 5) and/or with one or more screws or studs 46 (FIG. 6).

It will be appreciated that almost any type of securing means (as well as or apart from those illustrated) can be used, and it is preferred that when the two parts are secured together, the part 13 is deformed slightly either inwardly or outwardly so as to pre-load the part 17 to prevent rattling, especially that which results from relative movement between the tongue 33 and groove 35 during use of the lag.

One advantage of a sprung interlock is that screw fasteners are not required. Because aluminium is soft in comparison with screw fasteners which are normally made of steel, it would be preferable when using screw fasteners to provide a hard metal screwed insert in the top edge of the arm 21. If these are not provided, considerable wear will occur when a thread is formed directly into the aluminium alloy.

Figure 3:
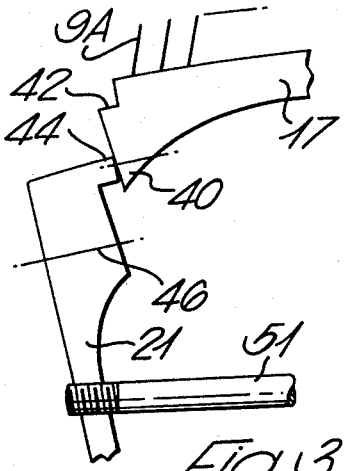
FIGS. 3–6 are scrap views showing alternative constructions of interlock between the two lag assembly parts at the trailing edge of the lag assembly.

If desired, one or more threaded members 51 may extend between the arms 19 and 21 to assist in moving these apart or together when it is desired to connect together or disconnect the two parts 13 and 17 (see FIG. 3).

The hinged connection 33, 35 described with reference to FIG. 2 can of course be replaced by alternative constructions of hinge which enable simple disconnection of the two parts. For example, a traditional hinge with a removable hinge pin could be used in place of the illustrated construction.

It will be noted that the arm 21 is slightly longer than the arm 19 although normally the pins 9A would be of uniform length and project uniformly from the convex surface of the part 17. The extra length in the arm 21 ensures that a greater combing action lakes place at the downstream end of the part 17 relative to the upstream or leading edge. This construction is easier to manufacture than staves with progressively varying pin projection.

What is claimed is:

1. A lag assembly for a Kirschner beater comprising a support part for connection to a leg of the spider of the beater and a working part, a plurality of pins projecting from said working part, which pins are so located in said working part that their tips provide a working surface which is convex when viewed tansverse to its length, means adjacent one longitudinal edge of said working part removably, hingedly securing said working part to the said support part and further means adjacent an opposite longitudinal edge for fixedly securing said working part to the adjacent edge of said support part.

2. A lag assembly according to claim 1 wherein said support part has a base and two upstanding wall portions giving said support part a channel-shaped cross-section, and means associated with said base part of the channel for permanently connecting said assembly to an arm of a spider of a Kirschner beater.

3. A lag assembly according to claim 2 wherein one of said upstanding walls of the channel has a curved groove formed therein and wherein a hook is formed on said one edge of said working part, said hook being engageable in said curved groove.

4. A lag assembly according to claim 2 wherein one or more fixing screws are provided fixedly to secure together said other upstanding wall of the support part and said working part.

5. A lag assembly according to claim 4 wherein said one or more fixing screws extend substantially at right angles to the base of the channel.

6. A lag assembly according to claim 1 wherein said opposite longitudinal edge of said working part has a depending flange for connection with said support part, thus permitting said pins to extend over substantially the whole surface of the working part.

7. A lag assembly according to claim 1 wherein said opposite longitudinal edge of said working part has a projecting rib for connection with said support part, thus permitting said pins to extend over substantially the whole surface of the working part.

8. A lag assembly according to claim 1 wherein said opposite edge of said working part and the adjacent edge of said support part form a snap-fit with each other.

9. A lag assembly according to claim 1 wherein one of said support and working parts is deformed slightly prior to securing said two parts together to prevent any relative movement between said two parts during use.

10. A Kirschner beater for a cotton opening machine, the beater being rotatable about an axis and having a plurality of radially extending arms each having a lag assembly on its outer end, said lag assemblies each comprising a support part for connection to a leg of the spider of the beater and a working part, a plurality of pins projecting from said working part, which pins are so located in said working part that their tips provide a working surface which is convex when viewed transverse to its length, means adjacent one longitudinal edge of said working part removably, hingedly securing said working part to the said support part and further means adjacent an opposite longitudinal edge for fixedly securing said working part to the adjacent edge of said support part.

11. A Kirschner beater as claimed in claim 10 wherein the hinged connection between the two lag assembly parts is at the leading edge of the lag assembly.

12. A Kirschner beater for a cotton opening machine, the beater being rotatable about an axis and having a plurality of radially extending arms each having a lag assembly on its outer end, the lag assemblies being secured to the arms and including a support part and a working part, the working part having a longitudinally extending pinned surface which is convex transverse to its length, and wherein one longitudinal edge of the working part is removably and hingedly connected to a corresponding edge or the support part, the opposite edges of the two parts being fixedly secured together after they have been brought together by pivoting of the working part about its one end.

13. A Kirschner beater as claimed in claim 12 wherein the hinged connection between the two lag assembly parts is at the leading edge of the lag assembly.

* * * * *